US005369918A

United States Patent [19]

Beu

[11] Patent Number: 5,369,918

[45] Date of Patent: Dec. 6, 1994

[54] REINFORCEMENT ASSEMBLY FOR TELESCOPIC BLEACHERS

[75] Inventor: Roger H. Beu, Crystal Lake, Ill.

[73] Assignee: B & R Erectors, Inc., Crystal Lake, Ill.

[21] Appl. No.: 15,999

[22] Filed: Feb. 10, 1993

[51] Int. Cl.[5] ..... A47C 4/00

[52] U.S. Cl. ..... 52/9; 52/73

[58] Field of Search ..... 52/7, 8, 9, 73; 108/48; 297/452.39

[56] References Cited

U.S. PATENT DOCUMENTS 2,054,960 9/0936 Adamson .
2,183,056 12/1939 Albach et al. .
2,205,624 6/1940 Horn .
2,846,738 8/1958 Walworth et al. .
2,987,111 6/1961 Walworth .
3,222,827 12/1965 Smith .
4,909,000 3/1990 Mackintosh .

*Primary Examiner*—Carl D. Friedman
*Assistant Examiner*—Robert J. Canfield
*Attorney, Agent, or Firm*—McCaleb. Lucas & Brugman

[57] ABSTRACT

A structural assembly for preventing load distortion of a cantilever supported upper seat and foot supporting deck of a multi-tiered telescopic bleacher assembly which comprises a series of horizontally spaced vertically adjustable, floor engaging posts adapted to be anchored to a vertical supporting wall and underlying floor intermediate the support columns of the bleacher assembly. Each post carries a horizontal support beam and angle bracket at its upper end that extends beneath and is joined to the top row of bleacher seats and the foot supporting deck associated therewith to reinforce the bleacher's normal support framing against undesired deflection and bending.

3 Claims, 4 Drawing Sheets

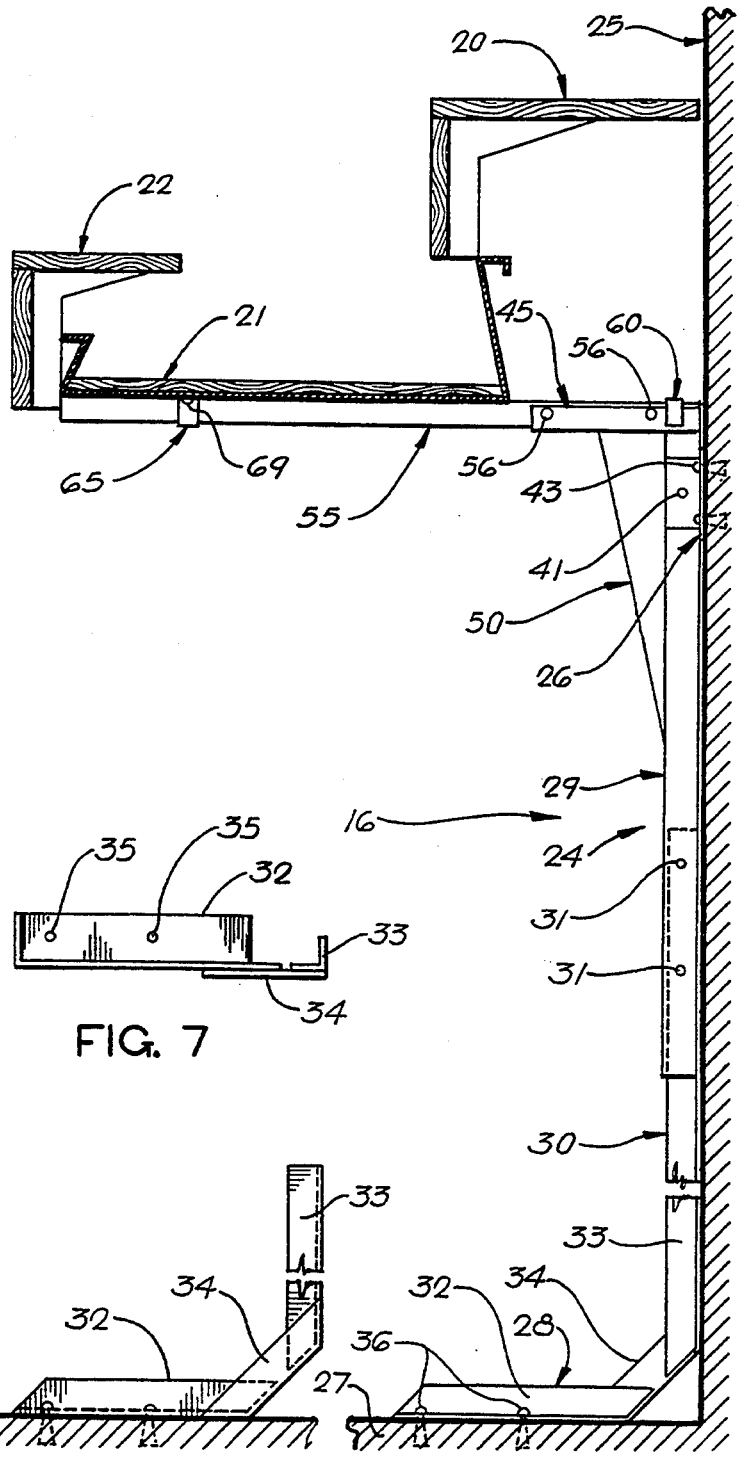
FIG. 7
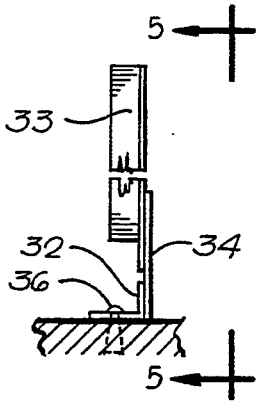
FIG. 6
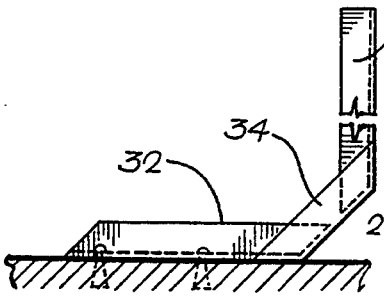
FIG. 5
FIG. 4

REINFORCEMENT ASSEMBLY FOR TELESCOPIC BLEACHERS

This invention relates generally to indoor bleachers of the telescopic folding type having multiple tier seating and more particularly to improved means for reinforcing cantilever deck supports and framework associated with the upper row of bleacher seats to prevent undesired distortion and failure thereof.

BACKGROUND OF THE INVENTION

In the typical telescopic bleacher structures employed in auditoriums, gymnasiums and like indoor enclosures, several rows of seats and foot boards or decks are normally mounted over horizontal cantilever support beams that are attached at one end to vertical support columns by bolted or welded brackets. When the bleacher assembly is extended the support columns of each successive row are moved beneath the outer ends of the cantilever beams of an overlying adjacent row of seats and decks. However, when the bleacher is folded or collapsed, the several rows of seats and foot supporting decks are in vertically superposed relationship with their support columns in side by side co-planar array and generally adjacent the rearward ends of the support beams. This leaves the seats and deck tiers cantilevered without support at their outer ends. Bleacher structures exemplary of the above described order are generally disclosed in U.S. Pat. Nos. 2,183,056, issued Dec. 12, 1939; 3,222,827, issued Dec. 14, 1965; and 4,490,949, issued Jan. 1, 1985.

While many improvements have taken place over the years in the folding bleacher art, such cantilever seat and deck support systems remain in popular use. Consequently, if the bleacher assembly is in a folded or stored condition and people either sit on the top or next row of seats or stand on the uppermost foot boards or deck associated therewith, the mainframe members of the bleacher structure may be bent and deformed with the cantilever support beams and their attachment brackets in particular being bent downwardly. When the bleacher assembly is next opened or extended, binding occurs between the supporting framework for the upper seat rows and adjacent underlying row of seats. The upper support beam and bracket are thereby forced upwardly to their normal position to overcome such binding. Repeated downward and upward bending of the cantilever beam and/or its support bracket in particular eventually causes breakage leading to more serious structural failures of the bleacher assembly including dislocation or failure of the connection between the vertical support columns and the guide wheel channels at their lower ends which guide the columns in the opening and closing operation of the folding bleacher assembly.

BRIEF SUMMARY OF THE INVENTION

This invention is directed to a structural assembly for avoiding and correcting the above noted defects and problems attendant to telescopic bleacher assemblies.

In brief, this invention is concerned with a structural assembly for reinforcing the top seat row and foot support or deck framework of a telescopic bleacher assembly for the purpose of preventing undesired deformation and damage thereto.

To that end the improved assembly of this invention comprises a series of vertically adjustable floor engageable posts which are anchored to a vertical supporting wall and to the underlying floor. Such posts are located intermediate the usual vertical support columns of the bleacher assembly and include a horizontal extending beam supported by a heavy angle brace extending between the beam and its wall anchored associated post. The thus rigidly supported horizontal beam serves to underbrace the top seat row and deck framework of the bleacher assembly for purposes of preventing bending and distortion thereof.

It is a principle object of this invention to provide an auxiliary support structure for bracing the top seat row and foot supporting deck of a telescopic bleacher assembly.

It is a further important object of this invention to provide an improved support system capable of preventing damage to the undersupporting structure of the top seat row and foot support in a telescopic indoor bleacher assembly.

Another important object of this invention is to provide a simplified support system capable of being installed in a telescopic bleacher assembly for preventing load distortion damage of cantilever supports for the upper seat and foot deck in a multi-tiered telescopic bleacher assembly.

Having described this invention the above and further objects, features and advantages thereof will be recognized by those of skill in this art from the following detailed description of a preferred embodiment of the invention, illustrated in the accompanying drawings.

IN THE DRAWINGS

FIG. 4 is an enlarged foreshortened, cross sectional view taken substantially along vantage line 4—4 of FIG. 1 and looking in the direction of the arrows thereof to illustrated the improved reinforcing structure of this invention and its relationship to the top tier or row of bleacher seats and foot supporting deck of the telescopic bleacher assembly;

FIG. 5 is a left hand side elevational view of the anchor assembly associated with the lower end of the reinforcing structure illustrated in FIG. 4, taken substantially from vantage line 5—5 of FIG. 6 and looking in the direction of the arrows thereon;

FIG. 6 is a foreshortened front elevational view of the anchor assembly shown in FIGS. 4 and 5;

FIG. 7 is a top plan view of the anchor assembly shown in FIGS. 4–6;

DESCRIPTION OF THE PREFERRED EMBODIMENT

Figure 3:
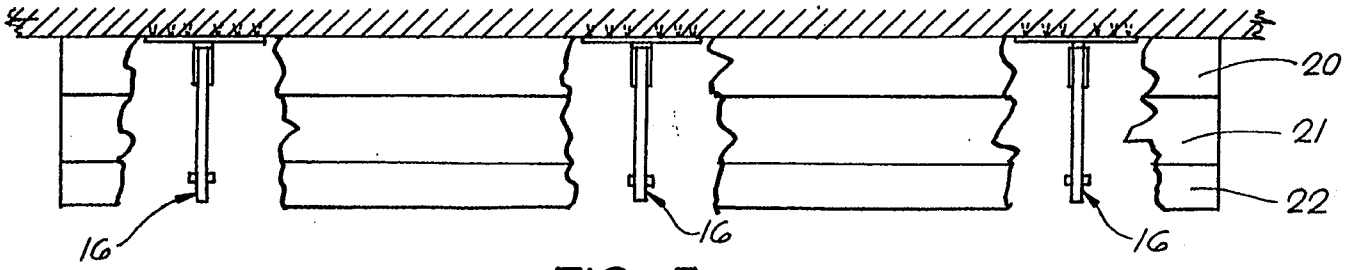
FIG. 3 is a top plan view of the assembly shown in FIG. 1 with portions broken away to illustrate the reinforcing structure of this invention.
Figure 2:
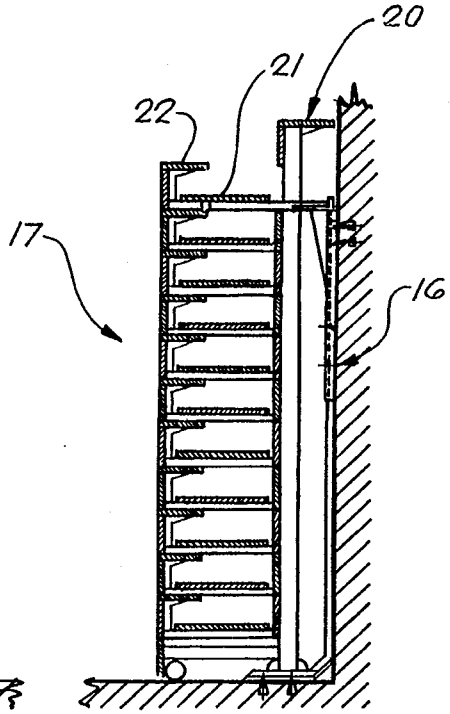
FIG. 2 is an end elevational view of the assembly shown in FIG. 1.
Figure 1:
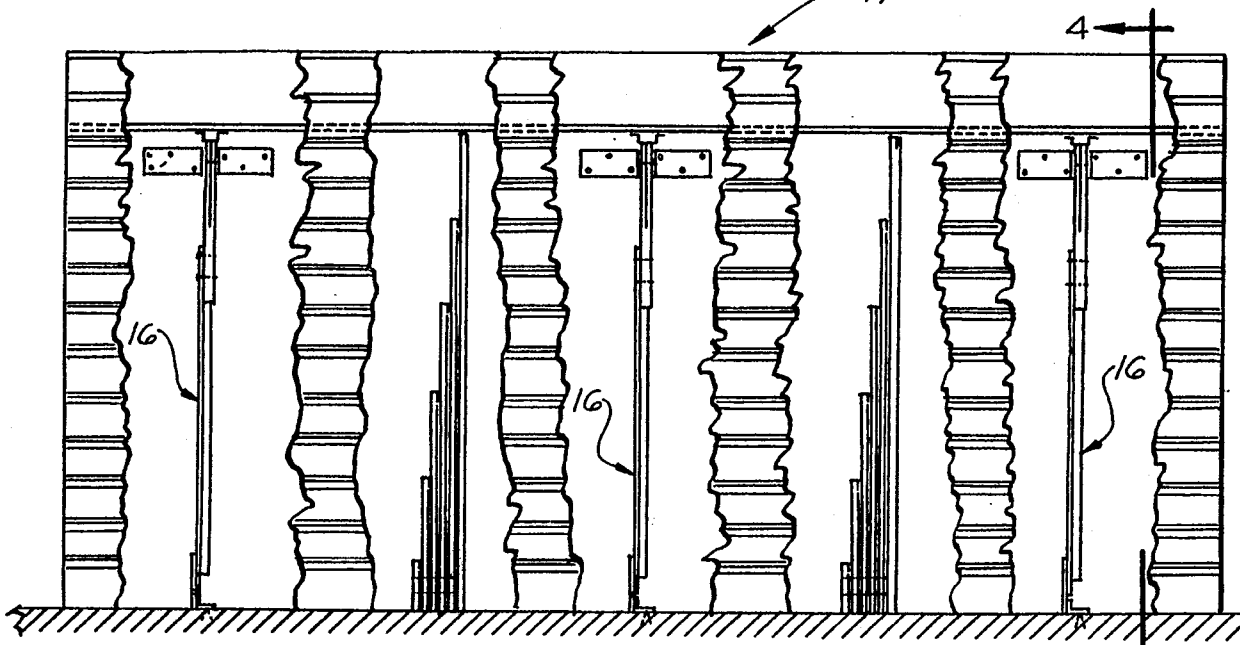
FIG. 1 is a partial front elevational view with portions broken away of a multi-tiered telescopic bleacher assembly equipped with the improved reinforcing structure of this invention.

Turning initially to FIGS. 1–3 of the drawings, it will be recognized that the improved reinforcement assembly 16 of this invention is therein shown installed with a multi-tiered telescopic bleacher assembly, indicated generally at 17.

More specifically bleacher assembly 17 of the order shown is normally constructed in standard sections which are thorn assembled side-by-side to achieve the desired bleacher length. In the herein illustrated case three of the reinforcement assemblies 16 of this invention are shown in FIGS. 1 and 3, the same normally being located in spaced relation approximately midway between adjacent deck supports of the bleacher assembly (not shown).

As best seen in FIG. 2, the bleacher assembly is in its folded or collapsed condition in which multiple tiers of cantilever supported seats and foot decks are superposed in vertical stacked relationship. When assembly 17 is opened or extended, all seats except the stationary top most bench 20 and its foot board or deck 21 with accompanying seat 22 are moved successively outwardly (bottom to top) to provide the familiar tiered bleacher seating. It will be understood that this invention is particularly directed to reinforcing the cantilever support for the upper foot deck 21 and its associated seat 22, as will appear presently.

With reference to FIG. 4, the structure of assembly 16 of this invention will be recognized as comprising a vertical rigid metal support post 24 which is secured to vertical wall 25 by anchor bracket 26 adjacent its upper end. At its lower end post 24 is secured to an underlying floor 27 by means of a floor bracket 28. As shown herein post 24 comprises a main section 29 formed as a hollow metal tube of rectangular cross section that receives a close fitting telescopic extension tube 30 coaxially within its lower interior. The extension tube section is slidably adjustable relative to the main section of post 24 to adapt assembly 16 to variations in the vertical distance between the top foot board or deck 21 and the floor 27, according to the number of seat rows and dimensions of the bleacher assembly. Spaced tie bolts 31 serve to interjoin the two tubular sections 29 and 30, as illustrated, once the proper length of the post 24 has been determined.

It is to be noted that the lower end of the extension tube 30 is fixed, as by welding, to floor bracket 28 which is made up of a pair of angle iron sections, forming arms 32 and 33, deposed at right angles to one another an rigidly interjoined in that relation by a gusset plate 34 extending angularly between the adjacent ends of arms 32 and 33 as best shown in FIG. 5–7. It also will be appreciated that flanges of the vertically disposed angle iron arm 33 are welded to the outside of the tubular extension 30 while the floor engaging flange of the other arm 32 is provided with spaced holes 35, 35 (see FIG. 7) receptive of anchor bolts 36 for fixing bracket 28 to the underlying floor 27.

Figure 8:
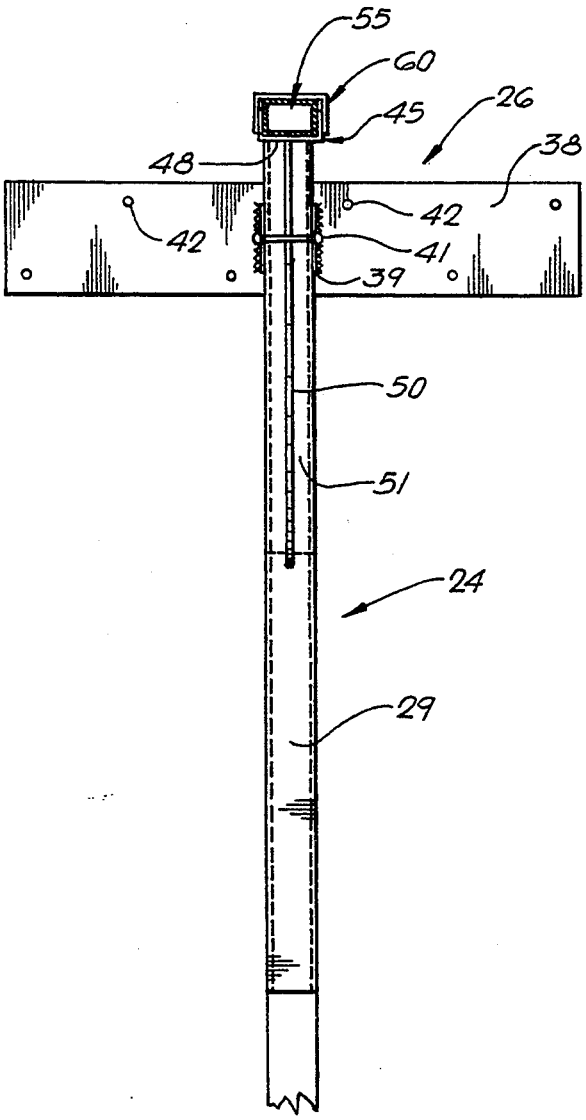
FIG. 8 is a partial enlarged front elevational view of the upper end portions of the reinforcing structure shown in FIG. 4, at an enlarged scale thereover.
Figure 9:
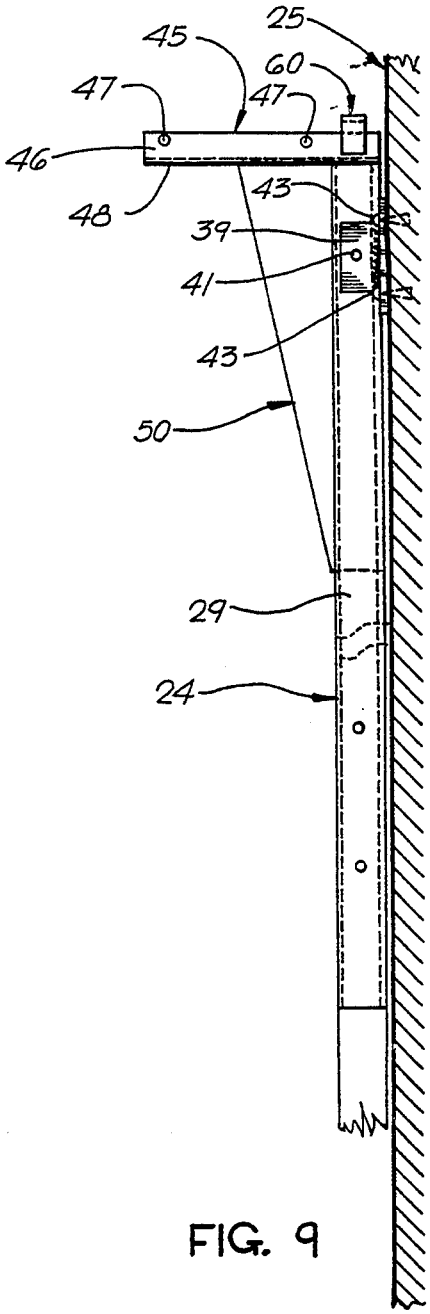
FIG. 9 is a side elevational view of the reinforcing structure shown in FIG. 8 and illustrating its anchored construction with a vertical wall.
Figure 16:
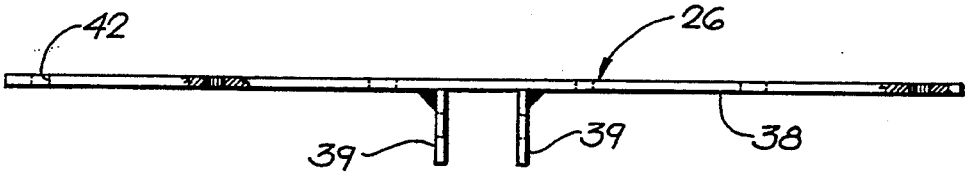
FIG. 16 is a top plan view thereof.
Figure 15:
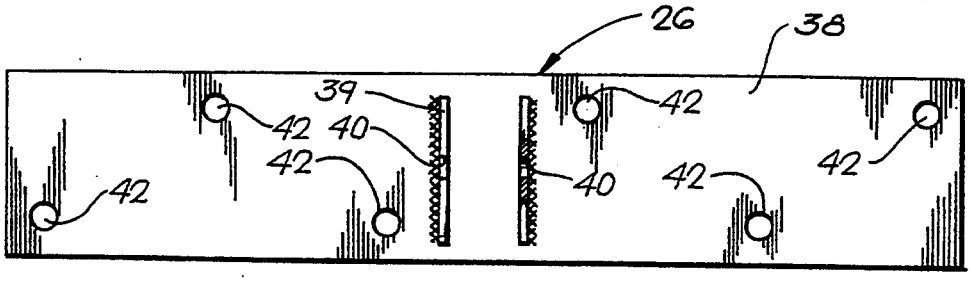
FIG. 15 is a front elevational view of the wall anchor assembly shown in FIGS. 8 and 9, but at an enlarged scale thereover.

It will be recalled that the post 24 is also anchored to an adjacent vertical wall 25 by means of wall bracket 26 as best shown in FIGS. 4, 8, 9; particulars of bracket 26 being set out in FIGS. 15 and 16.

As shown, the wall bracket is made up of a rectangular metal plate or base 38 having a pair of parallel spaced planar mounting ears 39, 39, welded to one face thereof so as to be symmetrically located on opposite sides of a central axis of plate 38. Each of the ears has a central opening 40 therethrough, which openings are coaxially aligned for passage of a tie pin or bolt 41 which also passes through an aligned opening in tubular section 29 of the post 24 to secure the post to the wall bracket (see FIG. 4).

Base plate 38 of the wall bracket is formed with a plurality of spaced holes 42, 42 for passage of anchor bolts 43 (see FIGS. 4 and 9) by which means bracket 26 is secured to wall 25 to provide a secure anchor for the upper end of the post 24.

Mounted at right angles to and extending across the upper end of the post 24, is an open top channel member 45 of U-shaped cross section which is welded at one end to and over the upper end of the vertical post section 29, as clearly shown in FIGS. 4, 8 and 9. The upwardly extending arms 46, 46 of this channel member are provided with registeringly aligned openings 47, 47 for the passage of bolt connectors as will appear presently.

Extending downwardly from the base wall 48 of the channel member is an elongated right triangular brace 50 made of relatively heavy metal plate which has its base welded to the underside of the channel member 45 and its elongated leg welded to the adjacent face 51 of the tubular post section 29 (see FIGS. 8 and 9) to not only brace channel 45, but to insure a right angular relation between the channel 45 and post 24.

Figure 10:
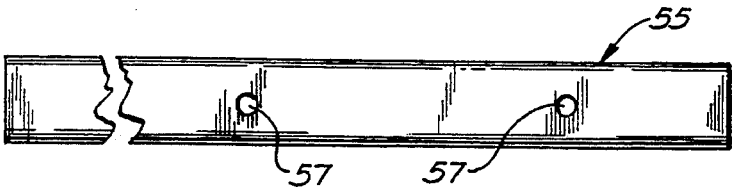
FIG. 10 is a foreshortened front elevational view of a tubular support member shown in FIGS. 8 and 9.
Figure 11:
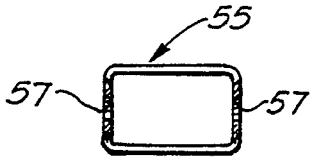
FIG. 11 is an end elevational view thereof.

An elongated tubular cantilever beam 55 of the rectangular cross section is nested between the parallel arms 46 of the channel member 45 and rigidly fixed thereto by tie bolts 56 which pass through the openings 47 in the channel member and corresponding openings 57, 57 in the beam 55 (see FIGS. 10 and 11)

A U-shaped safety strap 60 is mounted over the upper side of the beam 55 and welded to walls 46 of the channel member 45 to insure interconnection of the beam and channel in the event of failure of the tie bolts 56.

Figure 13:
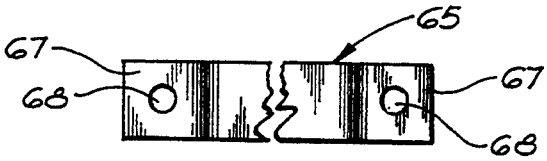
FIG. 13 is a top plan view thereof.
Figure 12:
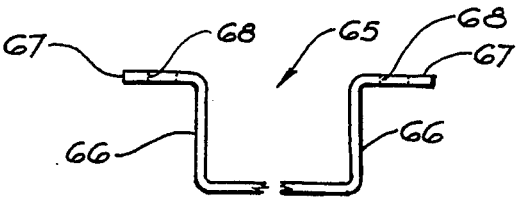
FIG. 12 is a foreshortened front elevational view of a connective brace shown in FIG. 4.
Figure 14:
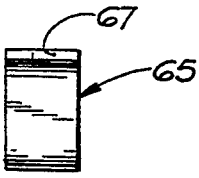
FIG. 14 is a side elevational view thereof.

Beam 55, as shown in FIG. 4, extends outwardly from the post 24 and its undersupporting channel member 45, beneath the top bench 20 and its associated foot deck 21 to undersupport the same. Connection between this cantilever support beam and the foot deck 21 is effected by means of a U-shaped strap bracket 65 detailed in FIGS. 12–14. As there shown the upright arms 66 of the U-bracket are turned outwardly at their outer ends to provide mounting flanges 67 having openings 68 therethrough. Lag bolts 69 of screw pass through the mounting flanges to connect with deck 21 (see FIG. 4).

It will be understood from FIG. 4, that when the bleacher assembly 17 is in its folded condition as shown in FIG. 2, the upper foot deck and associated seat row 22 are cantilever suspended as previously discussed. When people sit on the top bench 20, and stand or otherwise distribute weight to deck 21, the normal cantilever supports provided by the bleacher assembly are prone to downward deflection and binding. This condition becomes even more severe if people sit on the seat row 22 over the outer ends of the cantilever framework. However, by installing the reinforcement assembly 16 of this invention at spaced intervals beneath the top deck 21 as indicated in FIGS. 1 and 3, this bending problem is avoided.

From the foregoing it is believed that those skilled in the art will recognize the meritorious advancement of his invention and will readily understand that while the same has been described in association with a preferred embodiment thereof, illustrated in the accompanying drawings, numerous changes, modifications and substitutions of equivalents may be made therein without departing from the spirit and scope thereof which is intended to be unlimited by the foregoing except as may appear in the following appended claims.

The embodiments of the invention in which an exclusive property or privilege is claimed are defined as follows:

1. For use in a multi-tiered folding bleacher assembly having a top seat row and foot deck undersupported by plural cantilever beams extending from laterally spaced stationary upright posts when the bleacher assembly is in folded condition; each cantilever beam being supported by a stationary upright post and an additional moveable post of the bleacher assembly when the latter is extended, a supplementary structure for reinforcing the cantilever support of said top seat row and foot deck in the folded condition of the bleacher assembly, comprising:

plural, rigid, multi-part, telescopically adjustable, upright, tubular posts of quadrangular cross section anchored to a stationary support wall and an underlying horizontal floor and disposed intermediate and parallel to the spaced stationary posts of the bleacher assembly;

a rigid channel member of U-shaped cross section, open over its top side and rigidly fixed to and extending across the upper end of each of said tubular posts;

a rigid angle brace fixed to and extending downwardly between said channel member and associated tubular post, for fixing the same in right angular relationship;

an elongated, tubular support beam of quadrangular cross section having an axial portion nested in said channel member and detachably connected thereto so that said beam extends in cantilever supporting fashion beneath said foot deck, U-shaped bracket means embracing said beam and secured to said foot deck for rigidly interjoining said beam thereto; and means for adjustably fixing the length of each said tubular post so that it extends from the floor to said foot deck to under brace the same.

2. The combination of claim 1, and a U-shaped safety strap fixed to said channel member and extending over said portion of said beam for holding said beam and channel member in nested relationship in the event of disruption of the detachable connection therebetween.

3. The combination of claim 1, wherein said adjustable post comprises a tubular main section of quadrangular cross section, and an extension section telescopingly closely fitted into one end of said main section, said main section being anchored to said wall and said extension section being anchored to said floor, and means for securing the main and extension sections together in selected positions for the purpose of adjusting the length of said post.

* * * * *